US006830412B2

(12) United States Patent
Pérez

(10) Patent No.: US 6,830,412 B2
(45) Date of Patent: Dec. 14, 2004

(54) DEVICE FOR DIGGING NARROW TRENCHES AND LAYING PREFABRICATED TONGUED AND GROOVED COMPONENTS

(76) Inventor: Eduardo Gómez Pérez, c/ Merindad de Montija 18 - Nave 9, Poligono Industrial Villalonquejar, 09001 Burgos (ES)

( * ) Notice: Subject to any disclaimer, the term of this patent is extended or adjusted under 35 U.S.C. 154(b) by 119 days.

(21) Appl. No.: 10/353,682

(22) Filed: Jan. 29, 2003

(65) Prior Publication Data

US 2004/0146360 A1 Jul. 29, 2004

(51) Int. Cl.[7] ..... E02F 5/10; F16L 1/028
(52) U.S. Cl. ..... 405/180; 405/174; 405/184.5
(58) Field of Search ..... 405/157, 174, 405/180, 181, 184.5; 37/366, 367, 372

(56) References Cited

U.S. PATENT DOCUMENTS

| | | | | | |
|---|---|---|---|---|---|
| 811,424 | A | * | 1/1906 | Mikolasek | 37/367 |
| 1,534,900 | A | * | 4/1925 | Bolin | 37/367 |
| 2,815,726 | A | | 12/1957 | Davenport | 405/183 |
| 3,421,609 | A | | 1/1969 | Schmunk | 193/2 R |
| 3,521,456 | A | * | 7/1970 | Blackwell | 405/157 |
| 4,031,709 | A | * | 6/1977 | Blankemeyer | 405/157 |
| 4,307,523 | A | * | 12/1981 | Reissinger et al. | 37/42 VL |
| 4,326,347 | A | * | 4/1982 | Ballinger | 37/94 |
| 4,552,485 | A | * | 11/1985 | Hammer | 405/184 |
| 5,320,451 | A | * | 6/1994 | Garvey et al. | 405/181 |
| 5,381,616 | A | * | 1/1995 | Disney | 37/94 |
| 5,707,175 | A | | 1/1998 | Geelhoed | 405/180 |
| 5,913,638 | A | * | 6/1999 | Lansdale | 405/179 |
| 6,189,244 | B1 | * | 2/2001 | Johnson et al. | 37/349 |

FOREIGN PATENT DOCUMENTS

| | | |
|---|---|---|
| ES | 2007868 | 7/1989 |
| FR | 2697550 | 5/1994 |
| GB | 2296304 | 6/1996 |

* cited by examiner

*Primary Examiner*—Thomas B. Will
*Assistant Examiner*—Tara L. Mayo
(74) *Attorney, Agent, or Firm*—John C. McMahon

(57) ABSTRACT

A trencher comprising a cutting disc (2) with a prefabricated tongued and grooved element feeder comprising a sweeper box (32) with a U-shaped transverse cross section closed at the front by a rake (34), in such a way that earth cannot fall inside it, and powered drive wheels operably frictionally pushing prefabricated tongued and grooved elements (33) in order to urge the elements together and to keep the different prefabricated tongued and grooved elements (33) coupled together during their descent into the inside of the sweeper box (32). This produces a temporary plank mould for the trench, so that the lowering and laying of the prefabricated tongued and grooved elements (33) inside the trench may be carried out automatically, safely, and in a working environment that is free of earth, thus enabling the correct linking of the elements.

15 Claims, 6 Drawing Sheets

DEVICE FOR DIGGING NARROW TRENCHES AND LAYING PREFABRICATED TONGUED AND GROOVED COMPONENTS

BACKGROUND OF THE INVENTION

The herein invention refers to a device for digging narrow trenches and laying inside them different sorts of prefabricated piping composed of short, straight and rigid sections, which are tongued and grooved to join together. Both the digging of the trench and the laying of the piping or pipes, as well as the compacting and final smoothing of the excavated material are carried out in a single operation and at a fair speed. The device of the invention has been developed in order to lay auxiliary piping for high speed railways, but it may also be used for electrical and communications cables in built-up areas, for irrigation canals, and so forth.

Devices for digging narrow ditches with the aid of disc trenchers are well-known. Thus, in the same applicant's document ES 8703560 a disc trencher is specified which is specially adapted to dig narrow trenches in compacted ground, using a cutting disc whose periphery is made up of a number of replaceable hard metal spikes, while the depth of cut may be regulated due to the fact that the chassis rests on the ground through the mediation of a wheel of adjustable height.

In turn the same applicant's document ES 2027503 specifies a device which, on the basis of the trencher specified in the former document, embodies means to support a cable reel and an oscillating guide tube for laying cable on the floor of the trench, thus permitting the digging of the trench and the laying of the cable in the same uninterrupted action.

However, all these devices are intended for the digging of trenches and the subsequent laying of cables served on reels, but they are not viable for the laying of prefabricated concrete pipes embodied in short sections and, naturally, completely rigid.

The problem that arises is that once the trench has been dug, steps have to be taken to ensure that no earth falls back into the trench as this would affect the regularity of the supports for the piping on the floor of the trench and, more importantly, the correct fitting and levelling of each pipe with the next one.

Document U.S. Pat. No. 5,707,175 specifies a device composed of a trench digger allied to a feeder-loader which is adapted for the laying of tongued and grooved piping. Its objective is to carry out more or less continuously the digging of the trench and the laying of the pipes. To this end the feeder-loader contains a certain number of pipe sections stacked vertically. A mechanical retainer releases at the opportune moment the lower pipe section and it is then the job of a hydraulic piston to fit it into the groove, greater in diameter, of the last pipe section to have been laid in the trench. Although such a solution solves the problems of lowering the pipe section onto the floor of the trench without the risk of any crumbling of the trench's walls and ensures the coupling and watertightness of the pipeline, it also entails a basically interrupted operation, that is to say lowering and pushing, as well as causing severe difficulties when it comes to regulating the digger's speed of advance and to aligning the successive pipe sections. As a result, the device is liable to breakdowns and interruptions.

BRIEF SUMMARY OF THE INVENTION

The device of the invention has been conceived in order to provide a fully satisfactory solution to this problem. To this end it has been projected to mount on one and the same vehicle the disc trencher, the means that enable the levelling and containing of the excavated earth, and, in particular, a sweeping box which, positioned behind the trencher, enables the earth to be levelled and contained by its exterior while the successive pipe sections, joined together and subjected to a thrust that allows a continuous pipeline to be formed, drop down in its interior. It is thus possible to achieve the digging of the trench of exact dimensions in any type of ground, whether compact or loose, while the earth at the sides is prevented from falling to the floor of the trench and causing problems for the support of the pipeline; meanwhile, the exceedingly fine finish of the digging on the floor of the trench constitutes an excellent bed on which to rest the rigid pipe sections over the ground. Moreover, the pipe sections are interlocked at their front end and deposited in the sweeper box with the aid of a certain longitudinal thrust, thereby behaving like an articulated polygon in the face of the small deviations in inclination to which they are subject.

The device which is object of the invention comprises a vehicle of traction which incorporates a disc trencher at its rear with a breadth of cut slightly greater than the breadth of the pipe sections. It attains a working depth adequate to the height of the pipe sections. As the pipe sections must lie at the level of the ground, the device incorporates a support wheel on which the trencher's chassis rests and which, since its height may be regulated, maintains the desired cutting depth.

At the rear of the disc trencher and horizontally to it, a roller-feeder is attached by one of its ends while its other end is supported on wheels. The pipe sections are deposited manually or with the aid of a forklift or excavator-loader equipped with a hydraulic grab. The roller-feeder is slightly inclined so that the pipe sections are moved horizontally to their longitudinal axis until they drop into a roller-pusher. This roller-pusher is aligned in the direction of movement and is also slightly inclined in such a way that the degree of inclination diminishes progressively to a minimal value, which is very close to the horizontal.

The pipe sections are trapped against the roller-pusher by a number of pneumatic drive wheels which transmit to them by friction a force that pushes the sections against each other and thus forces them to enter the trench. The speed at which the drive wheels turn is variable and regulated by means of a tachometer in the drive motor itself, which is what supplies them with their spinning motion; thus the speed at which they turn may be adapted to the speed at which the vehicle of traction advances, while it is anticipated that there will be some slippage between the drive wheels and the pipe sections, that is to say, the pneumatic wheels tend to displace the pipe sections at a speed faster than that of the device's movement over the ground since the maximum thrust effort absorbed by the pipe sections is limited by the coefficient of wheel/pipe section friction.

The sweeper box has a guideable blade backed laterally and at the same level as the ground in order to distribute the excavated material leaving most part of it in an excavation slope but reserving a small quantity for filling in the lateral grooves between the pipe sections and the trench walls. It comprises in its rear part two levelling blades for extending the excavated material and filling in the grooves between the pipe sections and the trench, as well as compacting rollers which compact and plane the excavated material used for filling in the grooves, by pressing it downwards and against the external walls of the pipe sections.

Although the device that has just been specified has managed to triple the speed of pipe laying and, at the same time, to halve the number of workers required in comparison with the pre-existing art, various problems have been detected which cause deterioration to the edges of the pipe sections as well as sporadic interruptions in the laying device.

In this regard, a first source of difficulty lies in the fact that the swinging stopper used to feed the pipe sections horizontally permits them to pass in compact groups until the first one comes into contact with the roller-pusher. As a result of this, the first pipe section is trapped laterally by the weight of the succeeding sections and is subjected to a friction of sufficient magnitude to cause its movement to be stopped and to prevent it from reaching the first thrust wheel. The solution proposed consists in substituting the swinging stopper with a rotating feeder, the movement of which is stepped in such a way that it only releases one pipe section at a time.

A second problem has been found to lie in the defective lateral alignment of the successive pipe sections once they have been trapped in the roller-pusher. It has been observed that if the pipe sections have sufficient freedom to move transversally in the roller-pusher, the tongues and grooves at their ends may not coincide and, since the whole line of pipe sections is subjected to a strong longitudinal thrust, the edges of the flanges that constitute the tongues and grooves may suffer some deterioration. The solution proposed lies in the fact that the drive wheels are of a width that coincides substantially with the central channel of the pipe-sections and this ensures that they are guided perfectly and the tongues and grooves of successive pipe sections are coupled together smoothly, without any interference.

A third problem was detected which has to do with the fact that, as the pipe sections are lowered, they describe a straight trajectory forming a slight angle with the ground as they are pushed by the device of the invention; but that once they have been deposited on the floor of the trench they logically adopt the same alignment as the ground. The upshot of this is that when they leave the device, the successive pipe sections tend to rest on each other at their upper side, as a result of which this area may suffer small breakages which, although they do not affect the good working order of the pipeline, contribute to a deterioration in its visual appearance. The solution proposed consists in inserting between successive pipe sections separators of some soft material that will absorb the shocks and prevent any direct contact between the upper parts of successive pipe sections.

In order to bring to a close the foregoing specification and to assist in the better understanding of the invention, a detailed description of a preferred embodiment will be given on the basis of a set of drawings that are attached to this specification, and where, merely for the purposes of guidance and in no way limiting, the following has been represented:

In these figures the numerical references correspond to the following parts and components.

1. Vehicle of traction.
2. Cutting disc.
3. Support wheel.
4. Feeder rollers.
5. Stopper.
6. Pusher rollers.
7. Drive wheels.
8. Drive motor.
9. Drive chains.
10. Guideable blade.
11. Levelling blades.
12. Compacting rollers.
13. Deflector.
14. Chassis.
15. Power take-off.
16. Bevel pinion.
17. Spikes.
18. Support fork.
19. Support piston.
20. Wheel fork.
21. Wheel swivel-head.
22. Wheel shaft.
23. Thrust springs.
24. Regulator nut.
25. Headless screw.
26. Roller-pusher assembly.
27. Stopper axis.
28. Stopper lever.
29. Grip.
30. Locking device.
31. Fixed catch.
32. Sweeper box.
33. Prefabricated tongued and grooved elements (pipe sections).
33'. Intermediate pipe section.
33". Pipe sections adjacent to intermediate section.
34. Rake.
35. Blade and compacting rollers swivel-head.
36. Axis of compacting rollers.
38. Lateral grooves.
39. Initial dig.
40. Levelled dig.
41. Compacted dig.
42. Ledge for lid.
43. Flange.
44. Groove for flange.
51. Rotating step-by-step feeder.
52. Rotating feeder discs.
53. Central axis of rotating feeder.
54. Honeycomb arms.
55. Toothed wheel.
56. Bolt.
57. Pneumatic activator.

58. Switch.
59. Feeler.
60. Separators.
61. Tongued and grooved sections.

DETAILED DESCRIPTION OF THE INVENTION

Figure 1:
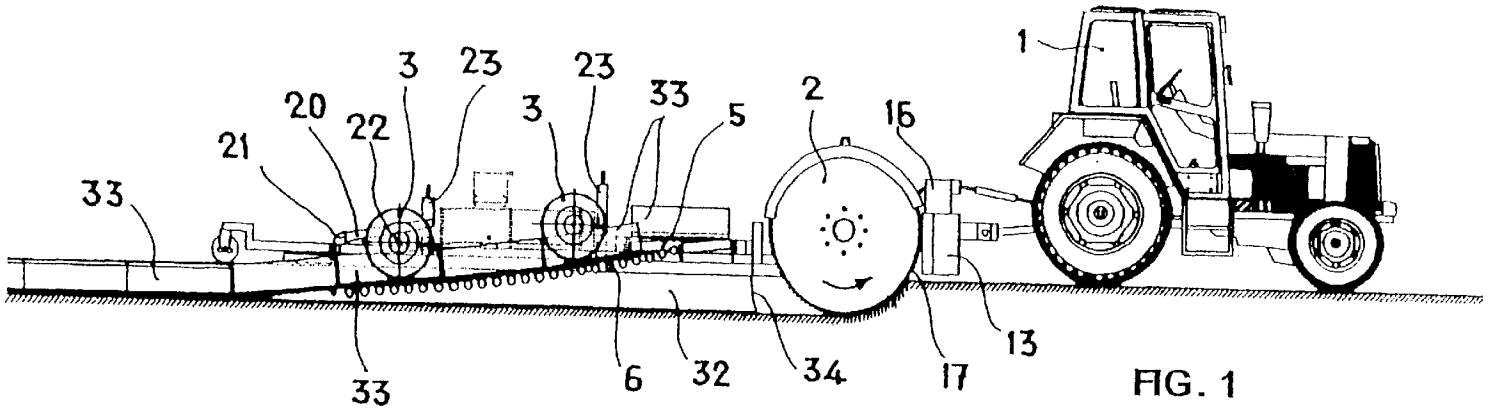
FIG. 1 shows a side-view of the device which is object of the invention.
Figure 2:
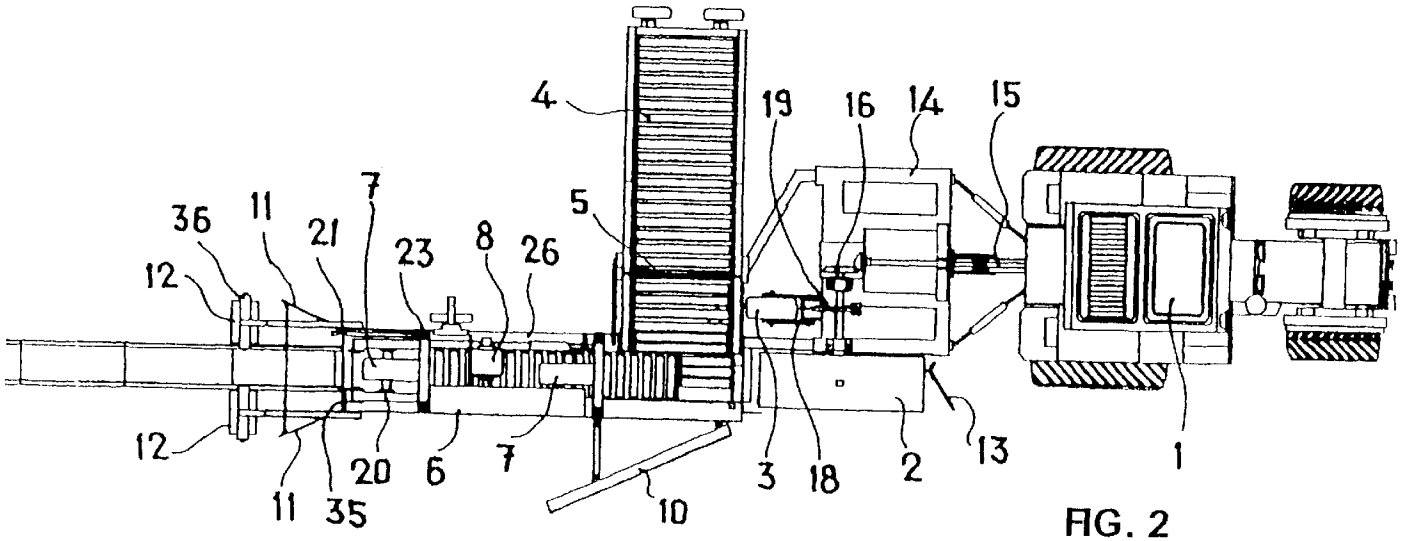
FIG. 2 shows the plan of the device which is object of the invention.

As can be seen in FIGS. 1 and 2, the device that is object of the invention is formed by a vehicle of traction (1), with great drawing power, to which is coupled a chassis (14) upon which is mounted a disc cutter (2), the spinning movement of which, in the opposite direction to the direction of progress, derives from the power take-off (15) of the vehicle of traction (1) through a conventional bevel pinion (16), while around the periphery of the cutting disc (2) are mounted a number of tungsten carbide spikes (17). The chassis (14) rests on a support wheel (3) mounted on a support fork (18), swivel-mounted on the chassis (14), and the position of which with respect to the chassis (14) is regulated by means of a hydraulic support piston (19). At the rear of the chassis (14), behind the disc cutter (2), is arranged a number of feeder rollers (4), positioned perpendicularly to the :direction of advance, which come to an end in a number of pusher rollers (6) in prolongation of the cutting disc (2) and, at the same time, slightly inclined towards the back. Upon their lateral mounts (26) are mounted two wheel forks (20) that tilt upon respective wheel swivel-heads (21) fitted with a wheel axis (22), upon which are mounted pneumatic drive wheels (7). These apply a noticeably vertical force to the pusher rollers (6) thanks to their respective thrust springs (23) that are compressed between the wheel fork itself (20) and a regulator nut (20) mounted on a headless screw (25) which is joined by means of a swivel-head to the side mount (26) of the pusher rollers (6). A drive motor (8) transmits its movement to the drive wheels (7) by means of drive chains (9).

Over the feeder rollers (4) a stopper (5) in the form of a vertical sheet of metal is mounted of a piece with a stopper axis (27) joined to a stopper lever (28) with a grip (29) at its end. Beneath this grip is accommodated a lock (30) that consists of a double articulated lever, the shorter arm of which may penetrate a fixed catch (31). See FIG. 5.

Beneath the pusher rollers (6) and joined to its lateral mounts (26) is mounted a sweeper box (32) made of thin metal plate and with a U-shaped transversal section, which is closed at its front by means of a rake (34) whose function is to prevent the dug soil, which is not expelled out of the trench by the cutting disc (2), from interfering in the proper laying of the pipe sections (33).

On the rear part of the lateral mounts (26) there are fixed with the aid of the swivel-head (35) a set of compacting rollers (12), which roll over the ground rotating freely around their roller axes (36), and a set of levelling blades (11), which move at a set height above the ground.

Figure 5:
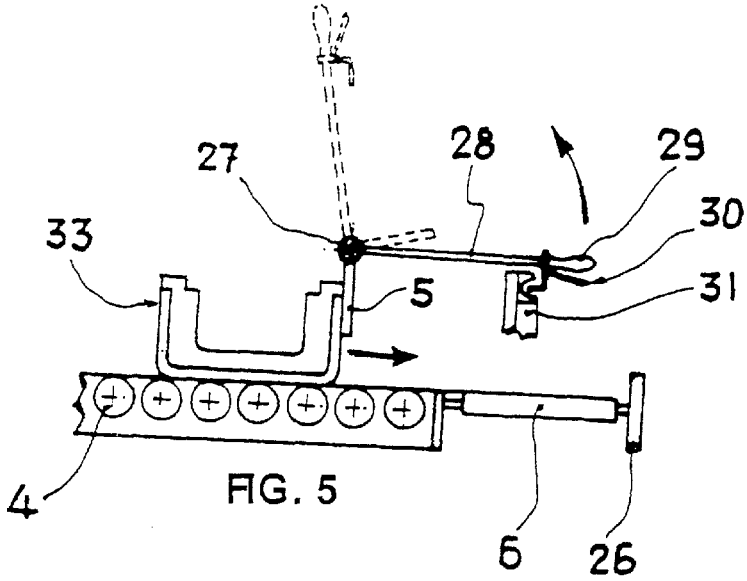
FIG. 5 shows a side view of the roller feeder with its stopper.

The device functions as follows: the pipe sections (33) are arranged next to each other in a transversal position with respect to the slope on the feeder rollers (4) and tend to move in the direction of the arrow, as indicated in FIG. 5, until they are retained by the stopper (5). The worker disengages the stopper by pressing on the locking device (30), at which moment the stopper lever (28) is released which may swing upwards, thus lifting the stopper (5) and allowing the pipe sections (33) to travel along the feeder rollers (4), due to their being inclined, until the reach the pusher rollers (6), where they are retained by the lateral mount (26).

Figure 6:
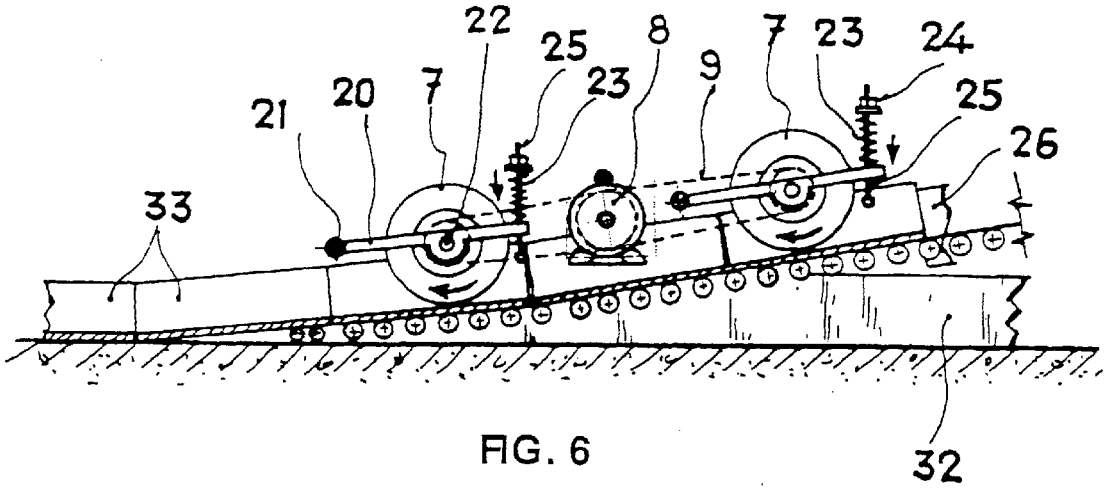
FIG. 6 shows a schematic longitudinal view of the roller pusher.

FIG. 6 shows in detail the structure of the roller pusher. The pipe sections (33) move towards the left of the figure due to the inclination of the roller feeder until they are trapped by the drive wheels (7) which apply thrust in the direction of the arrows thanks to their receiving a rotating movement, supplied by a drive motor (8), which is transmitted by respective drive chains (9). The force with which the pipe sections (33) are trapped by the drive wheels (7) against the pusher rollers (6) can be regulated by means of the regulator nuts (24) which act on the precharge of the drive springs (23). The greatest driving force that is applied to the group of pipe sections in order to force their insertion into the trench that has been freshly dug by the disc cutter (2) will depend on the resistance of the drive springs (23) and on the friction coefficient between the drive wheel (7) and the surface of the pipe sections (33). The drive motor (8) is of a dimension that generates a power that is greater than the maximum that may be transmitted by friction.

As a result, the pipe sections (33) are jammed against each other, thus interlocking together thanks to the insertion of some L-shaped flanges (43) at their front end into the corresponding flange grooves (44). See FIGS. 3 and 4.

The line of pipe sections, interlocked amongst themselves, is inserted at pressure and brought against the pipe sections already deposited in the trench, thus preventing any relative movement between contiguous pipe sections either vertically, transversally or longitudinally.

It is thus brought about that, when they cease to be borne on the pusher rollers (6), the pipe sections (33) do not fall brusquely into the sweeper box (32) which, moreover, is kept free of earth since it is closed off at the front by the rake (34).

In fact each pipe section remains momentarily suspended by the pipe section that follows it. This solves the problem of the pipe sections' being laid in the trench as one piece, that is to say, as a line of pipe sections and suffering a minimal twist when passing from the end inclination of the pusher rollers (6) to their definitive horizontal position.

In the device specified by way of preferred embodiment, two drive wheels (7) have been proposed, since this has been found to be the optimal number for laying pipe sections of a particular size, such as those used for auxiliary services for high speed railway lines.

For smaller pipe sections only one drive wheel (7) will be sufficient, while for large-scale pipe sections, the number of drive wheels (7) will need to be increased.

Figure 7:
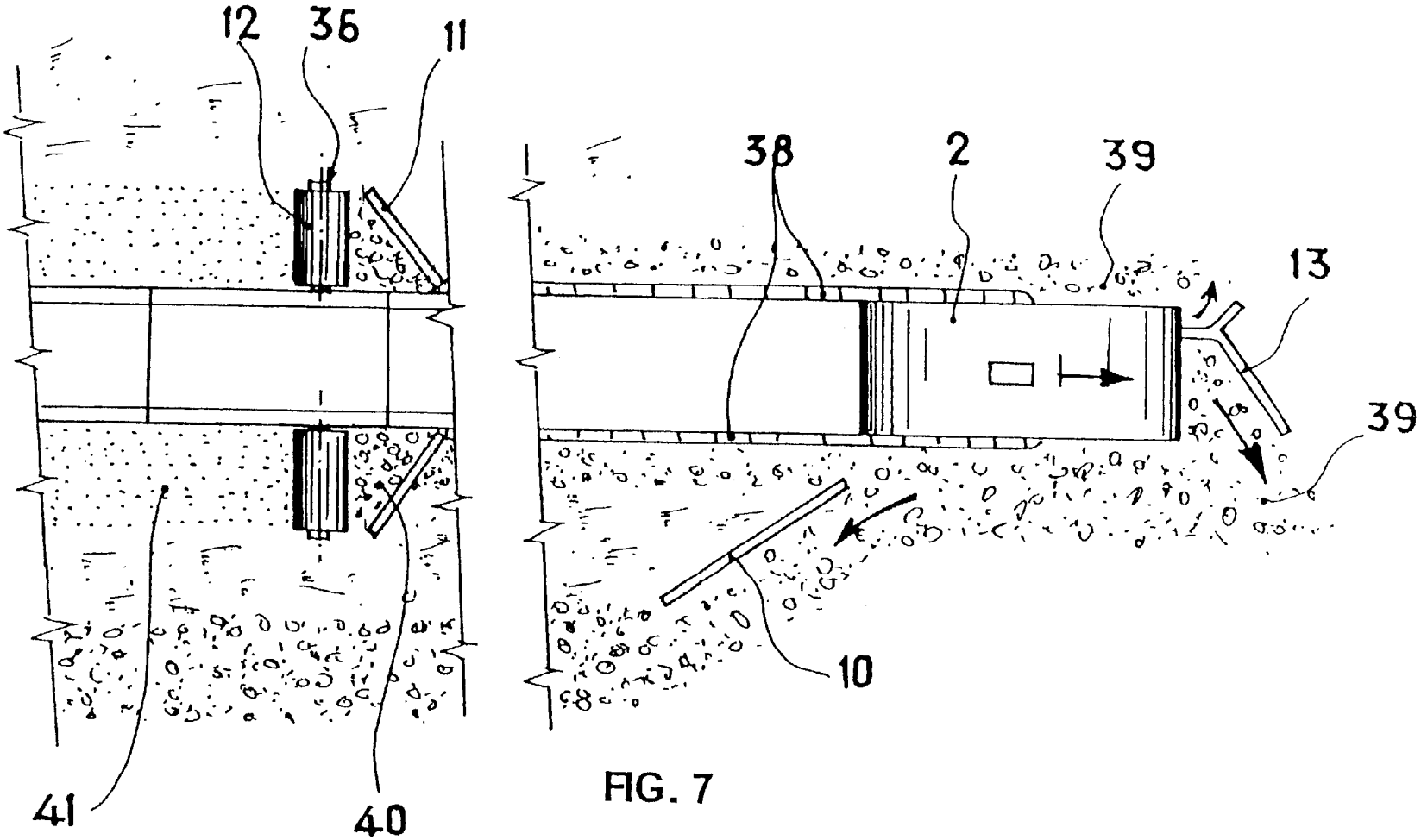
FIG. 7 shows schematically the plan of the successive treatment of the excavated earth.

In FIG. 7 the different elements that play a part in the digging and filling-in of the trench have been shown schematically. The trench is dug by the trencher's disc cutter (2), which expels the dug-out material forwards and upwards in order to be directed to each side of the trench by the deflector (13) positioned at the front of the disc cutter (2). The deflector (13) is in the shape of a Y, the arms of which are of different lengths, and is off-centre with respect to the disc cutter (2), so that the greater part of the excavated material (39) will be directed to one of the two sides, in this case to the right-hand side of the direction of motion. The mission of the guideable blade (10) is to separate the initial excavated material (39) on the side where it has mainly been accumulating into one small quantity close to the trench and similar to the quantity deposited by the deflector (13) on the opposite side of the trench and into another quantity, the greater part of the initial excavated material (39), which is removed to whatever lateral distance from the trench may be desired. This removed excavated material comprises the excavation's waste.

The levelling blades (11) move at a constant height over the ground since they are joined to the same chassis which bears the compacting rollers (12) which roll along the ground.

Their function is to transform the small initial amount of excavated material (39) left on each side of the trench into levelled-off excavated material (40) which occupies a greater breadth, thus filling in the lateral gaps (38) that are left between the exterior of the pipe sections (33) and the walls of the trench. Finally, the compacting rollers (12) smooth and compact the levelled-off excavated material (40) in order to leave it as compacted excavated material (41).

Figure 3:
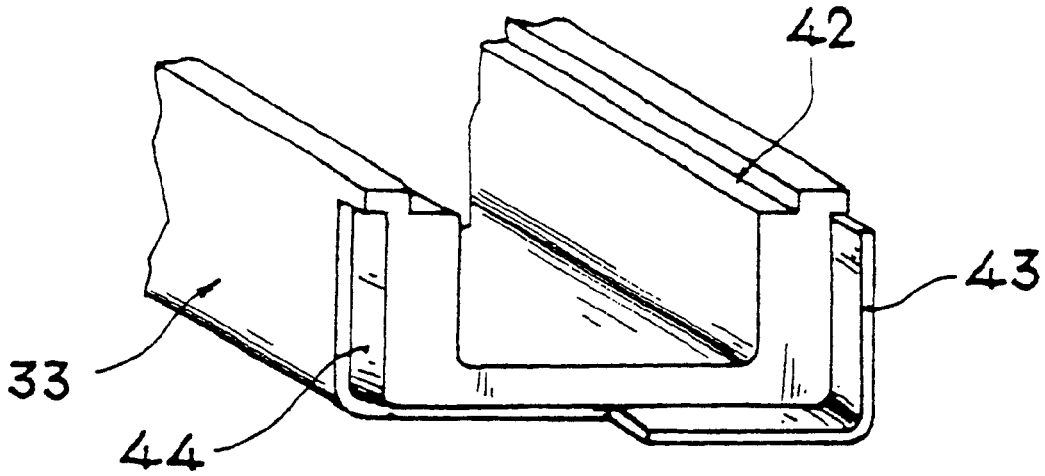
FIG. 3 shows a perspective view from above the front end of a pipe section.
Figure 4:
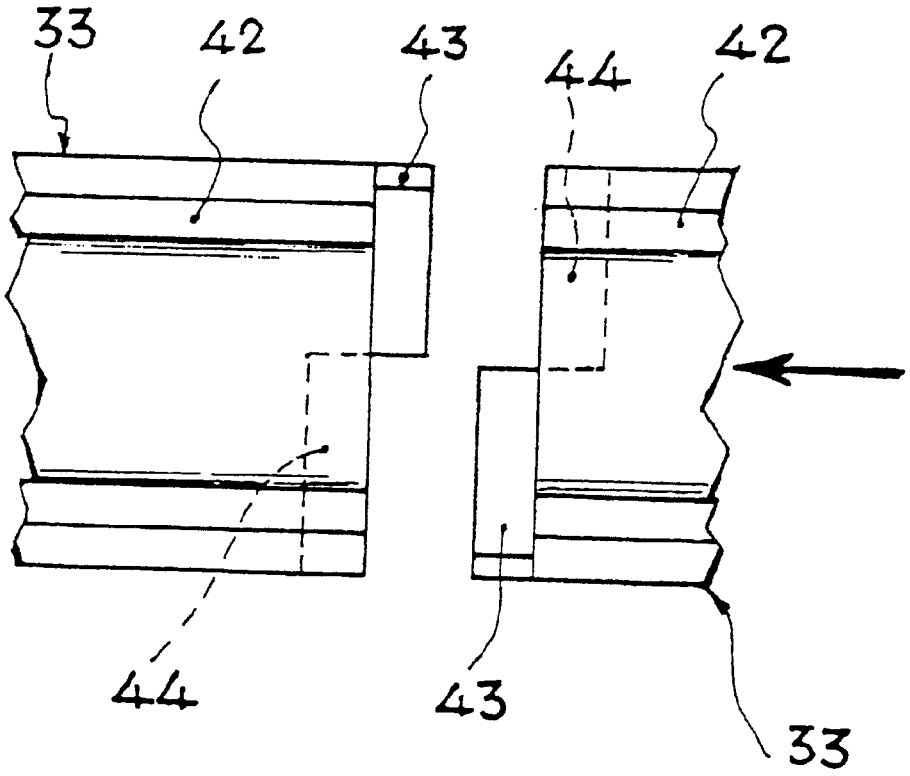
FIG. 4 shows the schematic plan of the tongue and groove coupling of the pipe sections.

In the specified example of a preferred embodiment, a type of pipe section (33) has been shown that is commonly used for the auxiliary pipelines of high-speed railways. Just as shown in FIGS. 3 and 4, the pipe section in question is embodied in concrete and has a U-shaped transversal section, open-at the top, where are to be found, one on each side, grooves for a lid (42) which allows the pipe sections (33) and their content to be covered with a lid which is not shown. It will be clear to an expert in the matter that the device which is object of the invention is also suitable for laying in a trench any other type of prefabricated rigid piping, for example hollow tubes with a rectangular outer perimeter which constitute a hollow pipeline, whether totally buried or not, into which electrical or communications cables may afterwards be placed.

Equally, other forms of embodiment, adapted to the type of prefabricated tongued and grooved elements which it is wished to deposit in the trench, will be obvious to an expert in the matter. Thus, in the case of laying cylindrical tubing, it will be convenient to substitute the groups of horizontal pusher rollers (6) with two groups of rollers at an angle to each other, or by three groups of drive wheels (7), each positioned at 120 degrees from the other.

Figure 8:
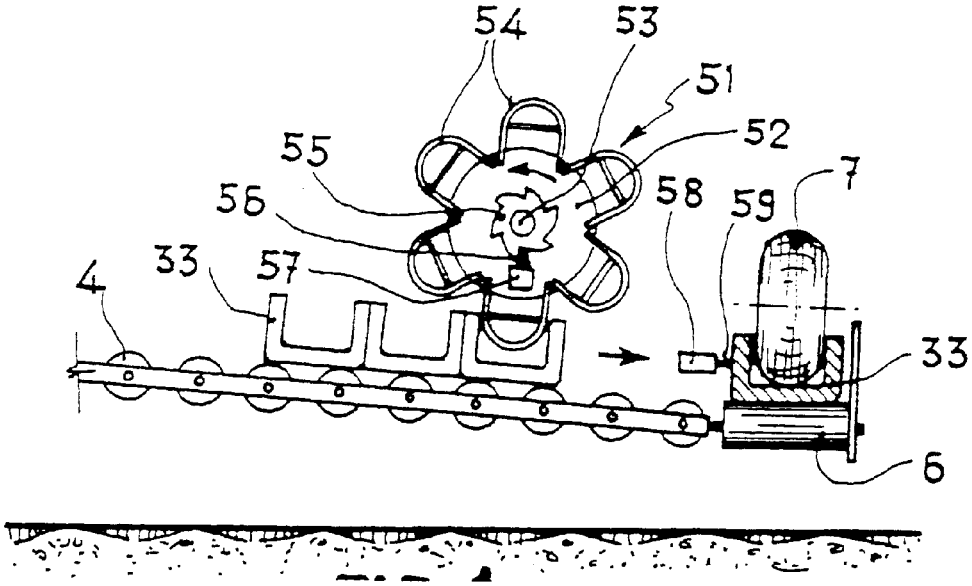
FIG. 8 shows a schematic side-view of the step-by-step rotating feeder used in the improved device.
Figure 9:
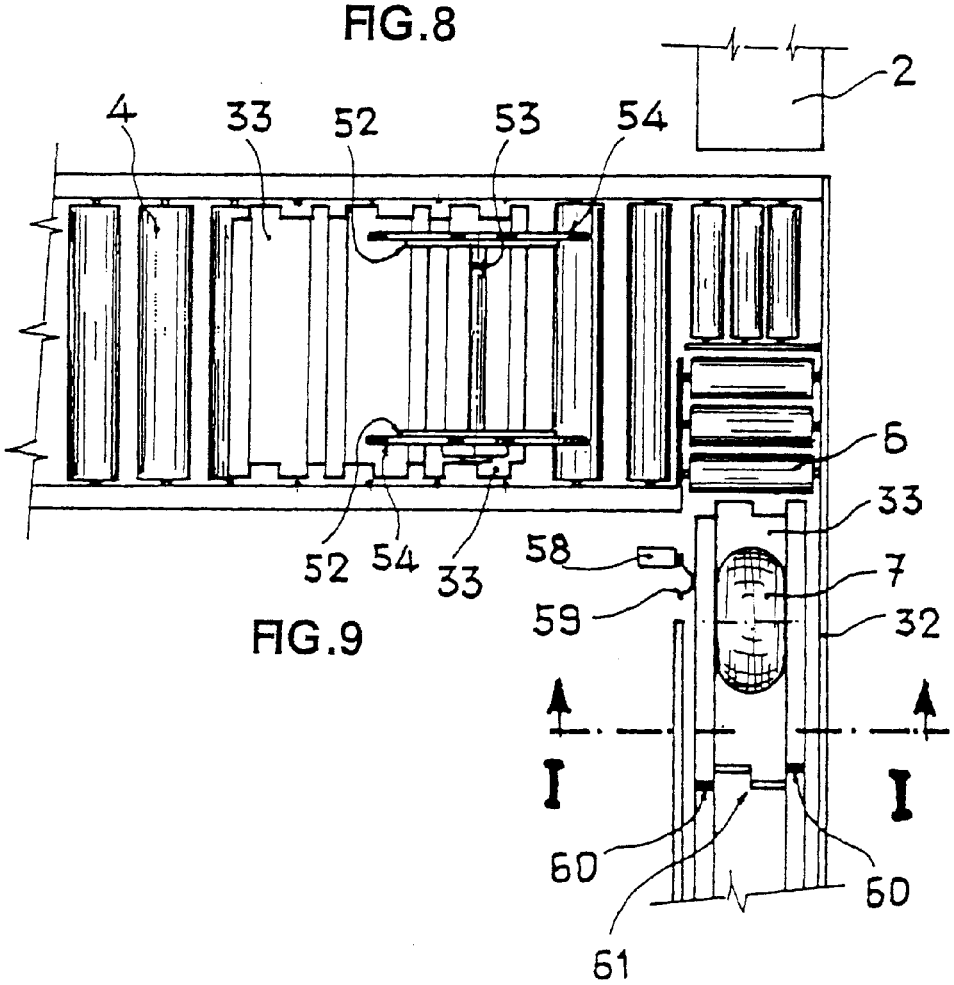
FIG. 9 shows the plan of the improved device.

FIGS. 8 and 9 show the improved device which comprises a rotating step-by-step feeder (51) mounted over the group of feeder rollers (4). This rotating step-by-step feeder (51) is constructed on the basis of two discs (52) joined by a central axis (53), onto which are soldered a number of honeycomb plates (54), semicircular in shape and preferably six in number, which are spread out at regular intervals around its periphery and stepped in such a way that is it possible to release one pipe section but to retain the following one. On at least on of the discs (52) is mounted a toothed wheel (55) and, in co-operation with it, a bolt (56) which can be moved by means of a pneumatic activator (57). In addition, a switch (58) equipped with a feeler (59) may detect the presence or otherwise of a pipe section (33 resting on the opening section of the pusher rollers (6).

The improved device works as follows.

Figure 10:
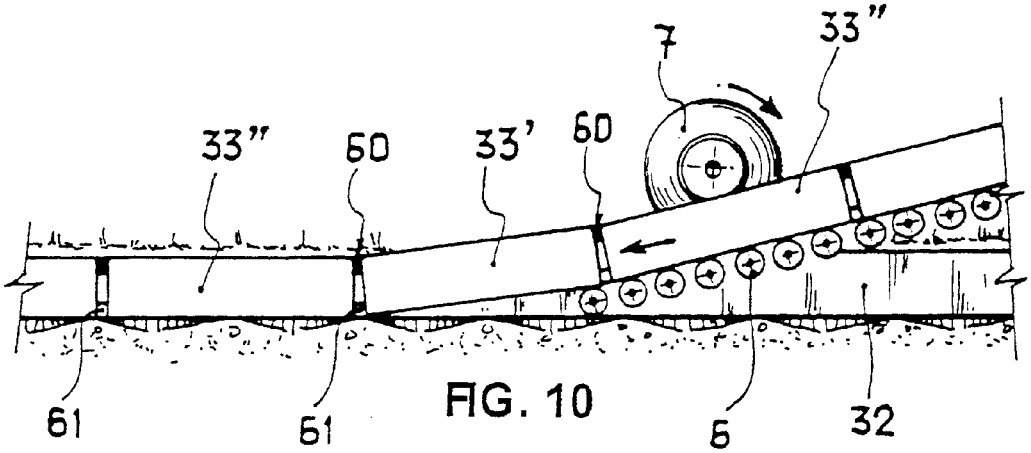
FIG. 10 shows a schematic longitudinal view of the laying of the pipe sections when separators are inserted, allowing a view of the broken line which they form on passing from the roller-pusher to the floor of the trench.

A group of pipe sections (33) deposited on the feeder rollers (4) will be retained by the first section because the honeycomb plates (54) of the rotating step-by-step feeder (51) will be inserted into the central channel of this first pipe section, while at the same time the bolt (56) prevents the rotation of the toothed wheel (55) and, thereby, the rotation of the whole rotating step-by-step feeder (51). When the last pipe section resting on the pusher rollers (6) is moved by the drive wheel (7) and the opening section of the pusher rollers (6) is freed, this absence is detected by the feeler (59) of the switch (58) mounted laterally against the pipe sections (33) and the pneumatic switch (57) of the bolt (56) is activated for a short space of time which is sufficient for the toothed wheel (55) to be disengaged. The toothed wheel (55) will thus permit the rotating step-by-step feeder (51) to make a sixth-turn, since it has the same number of teeth as there are honeycomb plates (54), on account of which turn the first pipe section will be moved from the feeder rollers (4) to the pusher rollers (6), while the following pipe section is retained by the rotating ste-by-step feeder (51). At this instant the idea is that separators (60) are put in place (one at the top, one between each pair of successive pipe sections) and thereupon trapped, guided and pushed by the drive wheel (7) as described above. The successive pipe sections (33) thus start to be lowered to the floor of the trench, resting on the pusher rollers (6), with always one intermediate pipe section (33') up in the air in the zone where the pusher rollers (69 come to an end, due to the scant height above the floor of the trench, this intermediate pipe section being borne by the tonguing and grooving (61) of the adjacent pipe sections (33"). See FIG. 10.

In this improved embodiment, it would be convenient for the drive wheels (7) to have as rounded a transversal profile as possible for, given that they couple almost seamlessly with the central canal of the pipe sections (33), they must allow the sections to move laterally if they are to be centred and kept away from the vertical walls of the sweeper box (32).

As for the separators (60), excellent results have been obtained from embodying them in expanded polystyrene since the exceeding cheapness of the material means that it does not matter if they undergo any permanent deformation during the laying of the pipe sections. It will be obvious to an expert in the matter that in the case of the laying of other prefabricated tongued and grooved elements in order to form a watertight pipeline, as in the case of tubes, great advantage would be derived from the use of an elastomerous material such as rubber for the separators, which would be placed inside the tonguing and grooving of the tubes beforehand.

What is claimed is:

1. A device for digging narrow trenches and laying prefabricated tongued and grooved elements in the trenches, of a kind including a cutting disc (2) and a prefabricated tongued and grooved element feeder, characterized in that the prefabricated tongued and grooved element feeder comprises:

a sweeper box (32) with a U-shaped transverse cross section, closed at the front by a rake (34) sized and positioned to be operably drawn through the ground to form the trench and being mounted in such a way to resist excavated earth from falling inside the trench;

means for pushing the prefabricated tongued and grooved elements (33), comprising a number of motorized drive wheels (7) operably engaging the tongued and grooved elements and transmitting by friction to those elements an axial thrust in order to keep the tongued and grooved elements (33) coupled together while the tongued and grooved elements are deposited into the inside of the sweeper box (32) by said feeder.

2. The device for digging narrow trenches and laying prefabricated tongued and grooved elements according to claim 1, characterized in that the cutting disc (2) is fitted with replaceable spikes (17) around its perimeter and is mounted on a chassis the chassis is supported on the ground by a support wheel (3), the position of the chassis being adjustable relative to the ground by a hydraulic support piston (19).

3. The device for digging narrow trenches and laying prefabricated tongued and grooved elements according to claim 1, characterized in that between each of the prefabricated tongued and grooved elements (33), a separator (60) is inserted, made of a less hard material, in such a way that direct contact between the elements is prevented.

4. A device for digging narrow trenches and laying prefabricated tongued and grooved elements, of the kind including a cutting disc (2) and a prefabricated tongued and grooved element feeder, characterized in that the prefabricated tongued and grooved element feeder comprises:

a sweeper box (32) with a U-shaped transversal section, closed at the front by a rake (34); mounted in such a way that the excavated earth cannot fall inside it;

means for pushing the prefabricated tongued and grooved elements (33), comprising a number of drive wheels (7) which transmit by friction to those elements a longitudinal thrust in order to keep the various prefabricated tongued and grooved elements (33) coupled together while they are deposited into the inside of the sweeper box (32); and wherein, the cutting disc (2) is motivated by a power take-off (15) of a vehicle of traction (1) with the mediation of a bevel pinion (16).

5. Device for digging narrow trenches and laying prefabricated tongued and grooved elements, of the kind including a cutting disc (2) and a prefabricated tongued and grooved element feeder, characterised in that the prefabricated tongued and grooved element feeder comprises:

a sweeper box (32) with a U-shaped transverse cross section, closed at the front by a rake (34); mounted in such a way that the excavated earth cannot fall inside the sweeper box;

means for pushing the prefabricated tongued and grooved elements (33), comprising a number of drive wheels (7) which transmit by friction to those elements a longitudinal thrust in order to keep the various prefabricated tongued and grooved elements (33) coupled together while they are deposited into the inside of the sweeper box (32); and wherein, the means of pushing the prefabricated tongued and grooved elements comprise a number of pusher rollers (6) upon which the said prefabricated tongued and grooved elements (33) are pressed together by a number of pneumatic drive wheels (7) which apply to those elements a downward force due to the fact that the said drive wheels (7) are mounted on a wheel axis (22) of a wheel fork (2), which is mounted in such a way that it tilts by means of a swivel wheel (21) on a set of lateral mounts (26) which support the pusher rollers (6), the wheel fork (20) being pushed downwards by springs (23) that are compressed between the wheel fork (20) itself and a regulator nut (24) mounted on a headless screw (25) which is articulated on the lateral mounts (26); and moreover the drive wheels (7) receive a spinning movement from a drive motor (8) by means of drive chains (9), as a result of which they transmit by friction a longitudinal push to the prefabricated tongued and grooved elements (33).

6. The device for digging narrow trenches and laying prefabricated tongued and grooved elements according to claim 5, characterized in that between the cutting disc (2) and the pusher rollers (6) are disposed a number of feeder rollers (4) which form a trajectory which runs transversally with respect to the device's direction of advance and is inclined for the prefabricated tongued and grooved elements (33).

7. The device for digging narrow trenches and laying prefabricated tongued and grooved elements according to claim 6, characterized in that over the group of feeder rollers (4), and close to its lowest part, is mounted a stopper (5) in such a way that it detains the prefabricated tongued and grooved elements (33) in their fall, precipitated by gravity, along the feeder rollers (4) upon which they rest.

8. The device for digging narrow trenches and laying prefabricated tongued and grooved elements according to claim 7, characterized in that the stopper (5) is mounted of a piece with a stopper axis (27) which bears a stopper lever (28) ending in a grip (29) beneath which is disposed a locking device (30) composed of a double articulated lever, the shorter arm of which is able to penetrate a fixed catch (31), in such a way that when the stopper lever (28) is immobilised by the locking device (30), the prefabricated tongued and grooved elements (33) are retained by the stopper (5), while once the locking device (30) has been disengaged from the fixed catch (31), the stopped lever (28) may rotate freely, and with it the stopper (5), thus permitting the passage of the prefabricated tongued and grooved elements (33) to the first pusher rollers (6), where they are retained by the lateral mount (26).

9. The device for digging narrow trenches and laying prefabricated tongued and grooved elements according to claim 6, characterized in that over the group of feeder rollers (4), close to their lowest part, is mounted a rotating step-by-step feeder (51), in such a way that it enables the feeding of one single prefabricated tongued and grooved element (33) each time such an element successively exits said feeder.

10. The device for digging narrow trenches and laying prefabricated tongued and grooved elements according to claim 9, characterized in that when the prefabricated tongued and grooved elements (33) are pipe sections with a U-shaped transversal section, the rotating step-by-step feeder (51) is constituted by discs (52) joined by a central axis (53) over which a fixed a number of honeycomb plates (54), distributed evenly around the periphery, and at least one toothed wheel (55) which may be immobilised by a bolt (56) that may be displaced by a pneumatic activator (57) controlled by a switch (58) equipped with a feeler (59).

11. The device for digging narrow trenches and laying prefabricated tongued and grooved elements according to claim 10, characterized in that the drive wheels (7) are pneumatic and of the same breadth as the central channel of the prefabricated tongued and grooved elements (33).

12. A device for digging a trench and laying tongued and grooved elements within the trench; the device including:

a) a driven trench forming cutting disk for operably engaging ground;

b) a feeder for operably feeding said elements into the trench;

c) a sweeper structure having a U-shaped cross-section and being operably positioned within and drawn through the trench; said sweeper structure being closed near the forward end thereof and being sized and mounted so as to resist earth that is excavated from the trench from falling inside the trench in the region of the sweeper structure; and d) a motorized drive wheel located so as to frictionally engage said elements as said elements are being fed by said feeder into the trench so as to impart a thrust to said elements and so as to urge said elements against one another and to remain coupled together when deposited in the trench.

13. In a device that digs a trench and positions a series of end to end joining elements, that include tongue and groove joining structure, into the trench; the improvement comprising:

a) a feeder for feeding said elements into the trench and having a motorized drive wheel for operably frictionally engaging each element and urging each element against a preceding element such that subsequent to being positioned in the trench, adjacent elements abut and are coupled together.

14. The device according to claim 13 wherein:

a) said drive wheel engages each successive element when said successive element is generally axially aligned with a preceding element, so that, as each element receives thrust from the drive wheel, each element abuts against and interlocks with elements on either end thereof.

15. The device according to claim 13 including:

a) a sweeper structure that is operably drawn through the trench and that clears a path for said elements;

b) said elements being fed by said feeder first into said sweeper structure and thereafter into the trench.

* * * * *